United States Patent [19]

Holm

[11] Patent Number: 4,463,483

[45] Date of Patent: Aug. 7, 1984

[54] FABRIC NAPPING APPARATUS

[75] Inventor: William J. Holm, Nashua, N.H.

[73] Assignee: W. H. Company, Inc., Ayer, Mass.

[21] Appl. No.: 356,948

[22] Filed: Mar. 11, 1982

[51] Int. Cl.[3] ..... D06C 11/00

[52] U.S. Cl. ..... 26/29 P; 15/256.53

[58] Field of Search ..... 26/29 R, 29 P, 35; 15/256.53

[56] References Cited

U.S. PATENT DOCUMENTS

| | | | |
|---|---|---|---|
| 494,152 | 3/1893 | Martinot | 26/29 R |
| 641,352 | 1/1900 | Wood | 26/29 R |
| 2,698,476 | 1/1955 | Hadley | 26/29 R |
| 3,026,596 | 3/1962 | Kuppers et al. | 26/35 |
| 3,390,437 | 7/1968 | Scholaert | 26/35 |
| 3,537,158 | 11/1970 | Dourdeville | 26/35 |

FOREIGN PATENT DOCUMENTS

| | | | |
|---|---|---|---|
| 9887 | of 1896 | United Kingdom | 26/29 R |

*Primary Examiner*—Robert Mackey

*Attorney, Agent, or Firm*—Morse, Altman & Dacey

[57] ABSTRACT

A high speed fabric napping apparatus is provided in which the fabric is fed in a straight line overpairs of worker rolls, one of each pair rotating in the direction of the pile of the fabric and the other rotating counter to the pile direction. The speed of each of the worker rolls is individually adjustable to control the tension applied to the cloth. A single cleaning roll is adapted to move back and forth amongst a plurality of worker rolls for removing lint collected by the worker rolls.

8 Claims, 8 Drawing Figures

FABRIC NAPPING APPARATUS

BACKGROUND OF THE INVENTION

1. Field of the Invention

This invention relates generally to textile machinery and more particularly is directed towards a new and improved apparatus for napping the face of an open width running fabric web.

2. Description of the Prior Art

In the manufacture of certain types of textile fabrics it is customary to nap one or both faces of the fabric by contacting the fabric face with power driven rotating brushes. In practice, a common apparatus for napping fabric in this fashion has been a planetary napping machine in which the cloth moves in a circular path about a cylinder with the planetary worker brushes spaced about the cylinder. In such planetary napping equipment, the speed of the cloth is limited for the reason that the fabric tends to balloon out at higher speeds accompanied by a reduction in the napping action.

It is an object of the present invention to provide a new and improved fabric napping apparatus.

Another object of this invention is to provide a napping apparatus in which the fabric is moved in a generally straight line through a napping zone.

A further object of this invention is to provide a fabric napping apparatus in which fabric can be carried at a high speed in a substantially straight line against independently adjustable worker rolls in rotating pairs.

Yet another object of this invention is to provide a napping apparatus in which the worker brushes are cyclically cleaned by a single movable cleaning roll.

SUMMARY OF THE INVENTION

This invention features a fabric napping apparatus comprising at least a pair of worker rolls in the form of rotary brushes of which one roll may rotate counter to the pile and the other roll may rotate in the direction of the pile of the fabric, with each roll being independently adjustable for selectively controlling the tension between the workers and the fabric. A single worker cleaning brush is adapted to move back and forth between two or more worker brushes to remove lint collected thereon in order to maintain an efficient napping action.

DETAILED DESCRIPTION OF THE PREFERRED EMBODIMENTS

Figure 1:
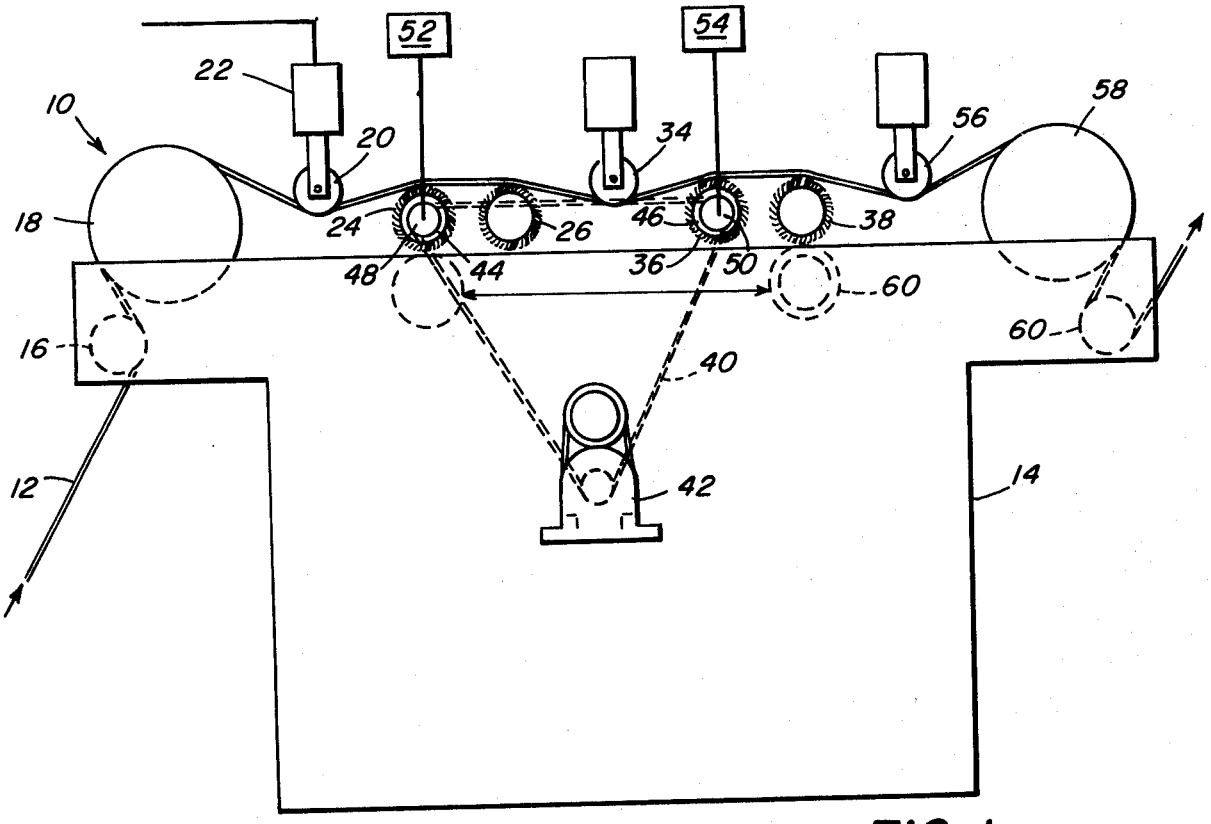
FIG. 1 is a somewhat schematic view in side elevation of a fabric napping apparatus made according to the invention.

Referring now to the drawings, the reference character 10 generally indicates an apparatus for napping at least one face of a running fabric web 12. The apparatus 10 is generally organized about a frame 14 carrying a number of different types of rolls employed in napping the fabric surface. For purposes of this disclosure, the word napping is intended to include operations such as sueding, tigering, brushing and the like, in which one or both faces of a running web are engaged by worker rolls that may be abrasive or covered with outwardly projecting wires of of various shapes. The web 12 is first fed in from the left hand side of the machine, as viewed in FIG. 1, about an idler roll 16 and then about a relatively large draw roll 18. From the draw roll 18, the fabric is fed under an application roll 20 which is adapted to move vertically and serves to apply pressure against the web in order to control tension on the web. The application roll may be spring-loaded to apply a steady pressure against the web or may be operatively connected to variable pressure mechanisms such as pneumatic or hydraulic cylinders 22, for example, which can raise or lower the application rolls selectively in order to achieve the desired longitudinal tension on the web. From the application roll, the web is carried over the tops of a pair of workers 24 and 26, the first worker typically rotating clockwise while the second worker rotates counterclockwise.

Each of the workers 24 and 26 typically is comprised of a cylindrical core 28 which is covered with a layer of fabric 30 having teeth or pins 32 projecting therefrom. The fabric with its teeth or pins may, for example, be generally similar to conventional napper roll cloth. As disclosed herein, the cloth 30 has pins 32 provided with bends whose included angle is approximately 135°. However, it is contemplated that teeth or pins of other types, both as to size and shape depending upon the particular operation to be performed, may be found useful. Desirably the pins 32 are of such length as to penetrate to the full depth of the nap layer particularly for a tigering operation. The nap is first lifted by the roll 24, which is rotating in a direction counter to the direction of the pile, for example. The nap is again lifted by the worker 26 which is rotating in the same direction as the pile, for example.

Figure 3:
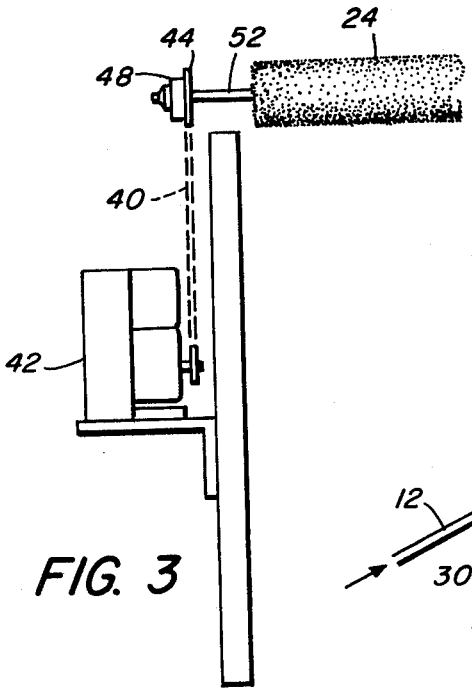
FIG. 3 is a detailed end view showing the drive mechanism for one of the brushes.

From the pair of worker rolls 24 and 26, the web is then carried under another application roll 34, also adapted to be raised and lowered in the same fashion as the application roll 20. The web is then carried over another pair of worker rolls 36 and 38, the worker 36, for example, rotating in a direction counter to the pile while the worker 38 rotates in the same direction as the pile, for example. The workers 24 and 36 of the illustrated embodiment are commonly driven as by a belt or chain 40 engaging a variable speed motor 42 mounted to the frame 14, as best shown in FIGS. 1 and 3. The chain 40 engages a sprocket gear 44 for the roll 24 and sprocket gear 46 for the roll 36. The sprocket gears 44 and 46 connect to their repsective workers 24 and 36 through a clutch mechanism 48 and 50 engaging a drive shaft 52 of the worker roll. The clutches 48 and 50 typically are of the friction type and may be operated by air, hydraulic, electrical or mechanical means, for example. In practice, each of the clutches is individually adjustable, preferably by a remote control unit, not shown.

The foregoing describes the drive arrangement for the counter pile worker rolls 24 and 36. The pile workers 26 and 38 are rotated in the opposite direction and are driven by an identical drive system which is located on the opposite side of the apparatus. All of the components are identical to those described in connection with the counter pile workers except that the drive is in the opposite direction.

Figure 2:
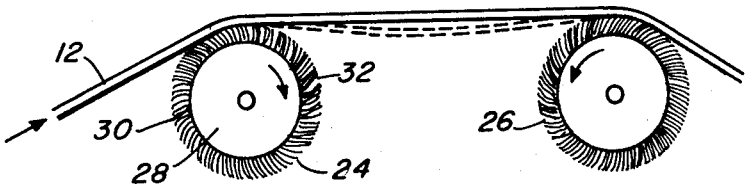
FIG. 2 is detailed view on an enlarged scale showing a pair of brushes in the FIG. 1 apparatus.

By controlling the speed of the workers and the power transmitted through individual clutches for the pile of counterpile worker, precise control is achieveable over the napping action of the workers in order to obtain the highest possible speed on the web coupled with optimum napping action on the web. As may be seen in FIG. 2, the web 12, as it moves over the tops of the workers 24 and 26, changes from a straight path that is generally tangential to the tops of the workers to a somewhat catenary droop shown in dotted line in FIG. 2. If there is any droop between two workers the wrap of the web about the workers is increased because of the direction of rotation of the workers. If the droop becomes excessive too much wrap will occur of the web about the workers, producing too much contact between the worker and the web, degrading the napping action in general and reducing production. The tension on the web applied by the application rolls 20 and 34 should be adjusted with the speed of the workers controlled by the motor 42 and the power applied to the workers through the individual clutches 48 so that the web will move in close to a straight line path between each pair of counter pile and pile workers.

In practice, the number of workers 24, 26, 36, 38 will vary depending upon the type of fabric to be processed and, typically, a single napping apparatus may be comprised of twenty-four to thirty-six workers. The illustrated embodiment shows only four such workers for the sake of clarification insofar as additional sets of rolls will be replications of the workers and drive arrangement already illustrated. Between each pair of counter pile and pile workers there will be an application roll similar to the application rolls 20 and 34 and an application roll at the end of the run such as application roll 56 in FIG. 1. Each of the application rolls is provided with adjustment means for controlling the tension of the web. From the final application roll, the web is carried about a variable speed draw roll 58 and around an idler roll 60 from which it is drawn to either a take-up roll or to another piece of equipment for further processing.

Figure 4:
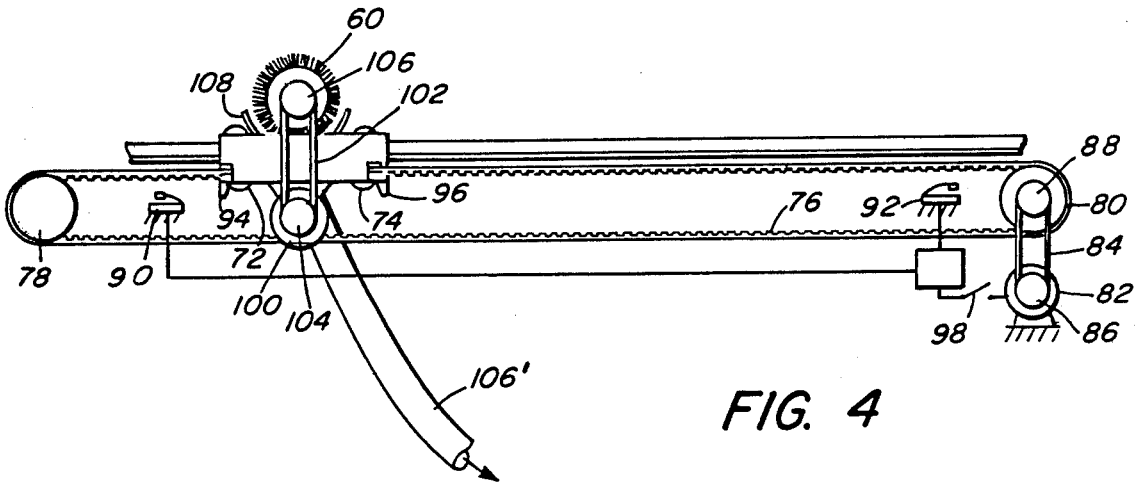
FIG. 4 is a view in side elevation showing the mechanism for moving the stripper brush from one worker to another.
Figure 5:
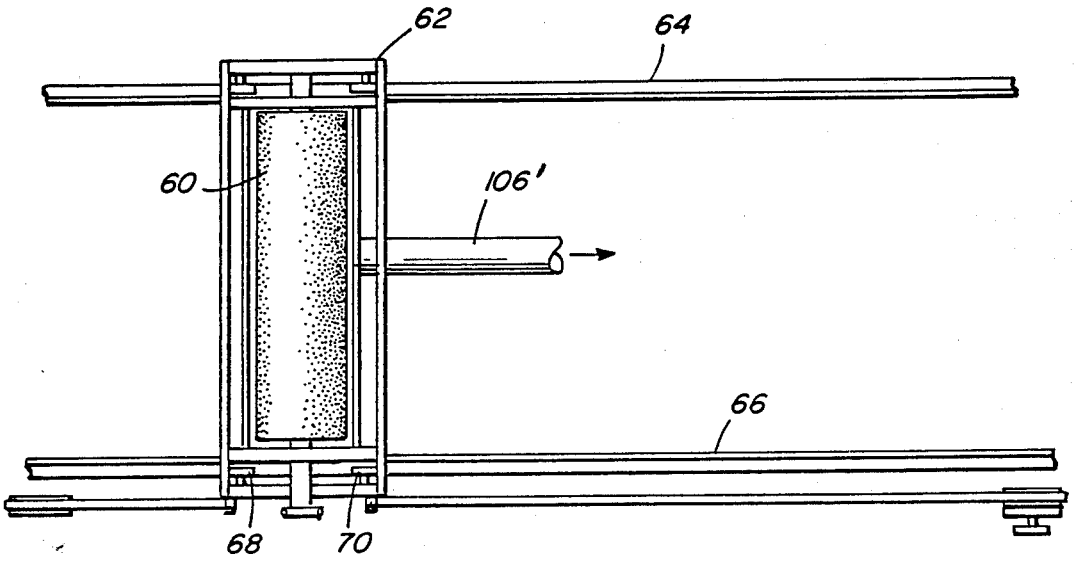
FIG. 5 is a top plan view thereof.

Operatively associated with the napping rolls is a cleaning system for removing fibers from the worker rolls. This system, as best shown in FIGS. 4 and 5, is comprised of a cylindrical stripping brush 60, the axis of which is parallel to the workers which it is serving and it is adapted to move back and forth along a path adjacent the worker brush serving a number of worker rolls. In the illustrated embodiment, one stripping brush 60 is shown serving four worker rolls and this number may be increased or decreased as desired according to particular requirements.

The stripping brush 60, which may be similar in construction to the worker rolls, is mounted to a carriage 62 which, in turn, is mounted to a pair of parallel horizontal rails 64 and 66 mounted to the frame 14 below the plane of the worker rolls. The carriage 62, in the illustrated embodiment, is provided with a set of four wheels 68, 70, 72 and 74 at each side of the carriage to engage the rails 64 and 66 in the manner shown. The carriage, together with its stripping brush 60, can be moved back and forth along the rails by various means and, as illustrated these means comprise a chain and sprocket system. This includes a chain 76 looped about a pair of spaced sprocket gears 78 and 80 with the chain 76 engaging the carriage and with one reach of the chain extending parallel to the rails. One of the sprockets, 80 in the illustrated embodiment, is driven by a motor 82 through another smaller drive chain 84 connected by a sprocket 86 and sprocket 88 to the motor 82 and the sprocket 80, respectively.

The motor 82 is reversible and is controlled by limit switches 90 and 92 at the end of each stroke of the carriage. The limit switch 90 is actuated by pin 94 on the carriage which will stop the left-hand movement of the carriage and again reverse the motor 82 whereby the carriage will move back and forth between the limit switches. A cut-off switch 98 is provided for stopping the movement of the carriage when necessary.

The brush 60 in the illustrated embodiment is driven by a motor 100 mounted to the carriage and driving the brush 60 through a belt 102 connected by pullies 104 and 106 to the motor 100 and brush 60, respectively. The motor drive for the brush 60 can be eliminated in certain cases where the brush will rotate sufficiently under contact with the rotating worker brushes. The stripping brush 60 will remove lint collected on the worker brushes as it moves into contact with the worker brushes. The lint picked up by the stripper brushes is carried away by means of a duct 106 connected to a vacuum system and the stripper brush is partially enclosed by a shroud 108 for maintaining vacuum around the stripper brush and to guide the fibers down into the duct 106'.

Figure 6:
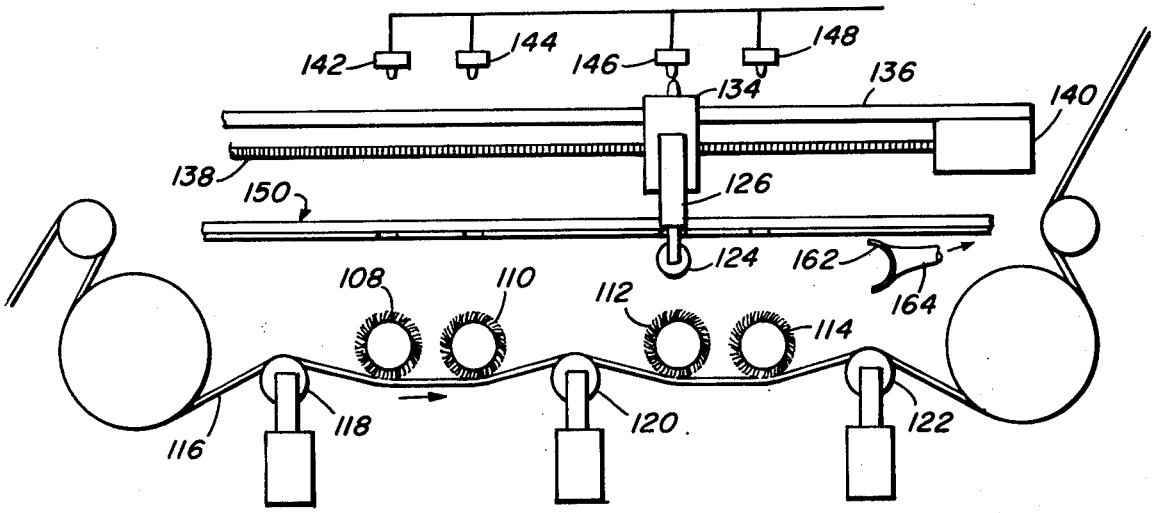
FIG. 6 is a somewhat schematic view in side elevation showing a modification of the invention.
Figure 8:
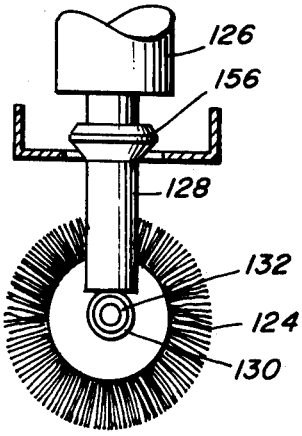
Figure 7:
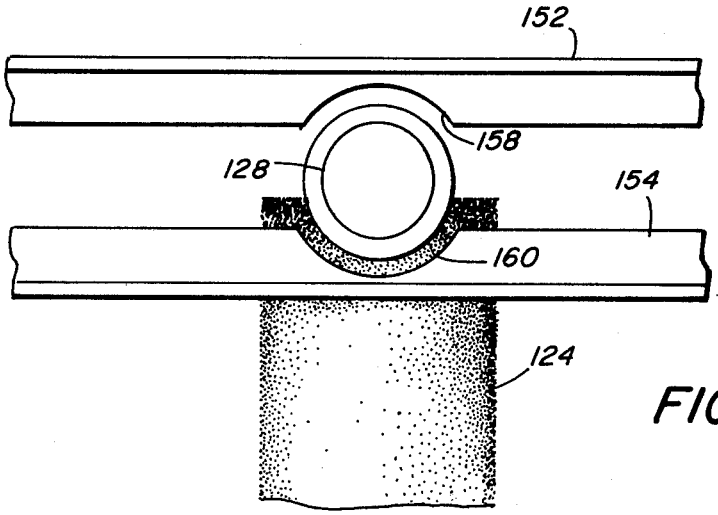
FIG. 7 is a fragmentary plan view showing details of construction of the FIG. 6 apparatus, and, FIG. 8 is a fragmentary side elevation showing details of construction of the FIG. 6 apparatus.

Referring now to FIGS. 6, 7 and 8 there is illustrated a modification of the invention and in this embodiment worker rolls 108, 110, 112 and 114 are positioned to engage the upper face of a running web 116 with the web being carried in a generally straight path over the tops of applicator rolls 118, 120 and 122. As in the principal embodiment, the applicator rolls 118 through 122 can be raised or lowered selectively in order to adjust the tension of the cloth against the workers 108 through 114 with the workers typically being arranged in pairs in the manner shown. The workers can be rotated in any desired manner such as both clockwise, both counterclockwise or one clockwise and the other counterclockwise with the direction of rotation normally determined by the particular type of fabric being worked upon and the particular finish desired on the material. The workers can be run at the same speed or by using clutch mechanisms such as employed in the principal embodiment or by using independently operated variable speed motors, the individual workers can be run at whatever speed or combination of speeds produces the best finish at the optimum production rate.

In the FIG. 6 embodiment, the workers 108 through 114 are cleaned from any lint build-up by means of a stripping brush 124 adapted to move back and forth above the workers and to drop down onto any selected worker to remove collected lint. The stripping brush 124 may be driven, if desired, or may be mounted for free rotation insofar as the cleaning action will occur even with a freely rotating brush 124.

The stripper 124 in the illustrated embodiment is carried on the lower end of a pair of hydraulic or pneumatic cylinders 126 with one on each end of the stripper brush 124. The lower end of a piston rod 128 extending downwardly from its cylinder 126 is provided with a bearing 130 engaging and rotatably supporting a shaft 132 for the stripper brush 124.

The cylinders 126 together with the stripping brush 124 is suspended below a carriage 134 adapted to ride along an upper guideway 136 and moveable along the guideway by suitable means such as a lead screw 138 driven by a reversible motor 140. Limit switches 142, 144, 146 and 148 are located along the path of travel of the carriage and are employed to stop the carriage at positions directly over each of the workers 108 through 114. Control circuitry allows the carriage to be advanced past any worker brush in the event that certain ones of the workers may require more frequent cleaning than others.

Once in position above a worker requiring cleaning, a remotely located switch is closed by the operator to actuate the cylinder 126, thereby lowering the stripping brush 124 onto a selected worker and holding it there until the worker is clean. At this point, the stripper brush is retracted and the carriage moved on to the next worker that is in need of cleaning.

To facilitate the guiding of the stripper brush 124 onto the worker, a guide channel 150 is provided parallel to and below the lead screw 138. The guide channel 150, as best shown in FIGS. 7 and 8, is comprised of a pair of spaced, parallel, horizontally extending angle sections 152 and 154 located on either side of the piston rod 128. A tapered collar 156 is mounted about the piston rod and rides along the top of the angle pieces 152 and 154 until a piston rod registers with arcuate notches 158 and 160 directly above each of the workers. In this position, the piston rod can pass through the guide 150 to lower the stripper brush in place and to retract it when the cleaning operation is finished.

When the stripper brush 124 becomes filled with lint it is retracted to the right, as viewed in FIG. 6, and received in a hood 162 connected by a duct 164 to a vacuum source adapted to carry away the accumulated lint.

While the invention has been described with particular reference to the illustrated embodiments, numerous modifications thereto will appear to those skilled in the art.

Having thus described the invention, what I claim and desire to obtain by Letters Patent of the United States is:

1. Apparatus for napping the face of a running fabric web, comprising (a) at least one pair of cylindrical rotatable worker brushes mounted in spaced parallel relation to one another adjacent the path of travel of said web and extending transversely thereof;

(b) guide means engaging said web for guiding said web in a generally straight line against said pair of brushes;

(c) variable speed drive means connected to said brushes for rotating the leading brush in a direction counter to the pile direction of said web and rotating the trailing brush in the same direction as said pile;

(d) individually controlled separate clutch means between said drive means and each of said brushes for independently controlling the power transmitted to each of said brushes; and (e) a rotary cylindrical stripping brush mounted parallel to said worker brushes for movement in a plane parallel to the plane of said worker brushes in a direction parallel to the reach of said web between said worker brushes, said stripper brush adapted to contact said worker brushes on a side opposite the side in contact with said web, and means for moving said stripper brush from one worker brush to another.

2. Apparatus according to claim 1 including power means drivingly connected to said stripper brush for power rotation thereof.

3. Apparatus according to claim 1 including vacuum means connected to said stripper brush for removing lint from said stripper brush collected from said worker brushes.

4. Apparatus according to claim 3 including guide means extending along the path of travel of said stripper brush and a carriage supporting said stripper brush and movable along said guide means.

5. Apparatus according to claim 4 including power means operatively connected to said carriage for moving said carriage along said guide means.

6. Apparatus for napping the face of a running fabric web, comprising (a) at least one pair of cylindrical rotatable worker brushes mounted in spaced parallel relation to one another adjacent the path of travel of said web and extending transversely thereof;

(b) guide means engaging said web for guiding said web in a generally straight line against said pair of brushes;

(c) variable speed drive means connected to said brushes for rotating said brushes at individual preselected speeds;

(d) a pair of application rolls both mounted in spaced parallel relation to said brushes in position to engage the face of said web opposite to the face engaged by said brushes, one of said application rolls positioned in advance of the leading brush and one of said application rolls positioned after the trailing brush; and (e) a rotary cylindrical stripping brush mounted parallel to said worker brushes for movement in a plane parallel to the plane of said worker brushes in a direction parallel to the reach of said web between said worker brushes, said stripper brush adapted to contact said worker brushes on a side opposite the side in contact with said web, and means for moving said stripper brush from one worker brush to another.

7. Apparatus according to claim 6 including power means drivingly connected to said stripper brush for power rotation thereof.

8. Apparatus according to claim 6 including guide means extending along the path of travel of said stripper brush, a carriage supporting said stripper brush and movable along said guide means and reciprocating means on said carriage and connected to said stripper brush for moving said stripper brush to and away from said worker brushes.

* * * * *